United States Patent [19]

Kawanishi

[11] 3,960,737

[45] June 1, 1976

[54] NEGATIVELY CHARGED LIQUID DEVELOPER FOR USE IN ELECTROSTATIC PHOTOGRAPHY

[75] Inventor: Toshiyuki Kawanishi, Tokyo, Japan

[73] Assignee: Kabushiki Kaisha Ricoh, Tokyo, Japan

[22] Filed: Aug. 13, 1973

[21] Appl. No.: 387,773

[30] Foreign Application Priority Data

Aug. 17, 1972 Japan ..... 47-81832

[52] U.S. Cl. ..... 252/62.1 L; 96/1 LY; 252/62.1 P

[51] Int. Cl.[2] ..... G03G 9/12

[58] Field of Search ..... 96/1 LY, 1.5 D; 252/62.1 L, 62 P

[56] References Cited

UNITED STATES PATENTS

| | | | |
|---|---|---|---|
| 3,507,794 | 4/1970 | Fauser et al. | 252/62.1 L |
| 3,668,127 | 6/1972 | Machida et al. | 252/62.1 L |
| 3,689,260 | 9/1972 | Honjo et al. | 252/62.1 L |
| 3,839,032 | 10/1974 | Smith et al. | 252/62.1 |

FOREIGN PATENTS OR APPLICATIONS

| | | | |
|---|---|---|---|
| 2,165,458 | 7/1972 | Germany | 252/62.1 |
| 46-8279 | 3/1971 | Japan | 252/61.1 |

*Primary Examiner*—David Klein
*Assistant Examiner*—Judson R. Hightower
*Attorney, Agent, or Firm*—Cooper, Dunham, Clark, Griffin & Moran

[57] ABSTRACT

Negatively charged liquid developers for use in electrostatic photography which comprises a highly insulating carrier liquid and, dispersed therein, a toner comprising colored particles coated with a synthetic polymer composition which is a mixture of vinyltoluene-butadiene or styrene-butadiene reaction products with acrylic and methacrylic acid and alkyl esters of such acids wherein the alkyl group contains 6 to 18 carbon atoms.

20 Claims, No Drawings

NEGATIVELY CHARGED LIQUID DEVELOPER FOR USE IN ELECTROSTATIC PHOTOGRAPHY

BACKGROUND OF THE INVENTION

1. Field of the Invention

This invention relates to negatively charged liquid developers for use in electrostatic photography, which contain novel highly negatively charged toners. The developers are particularly characterized by their stable polarity and the dispersibility of the toners. The developers may be in either concentrated or dilute form as described herein.

2. Description of the Prior Art

Negatively charged liquid developers for use in electrostatic photography have been broadly used for negative-positive development of electrophotographic photosensitive papers and electrostatic recording papers. Toners used for such liquid developers are usually prepared by blending and kneading colored particles, i.e. pigment or dye particles with a resin, a fat or an oil acting as a polarity-controlling and dispersion-stabilizing agent. Typical of such resins, fats and oils which have been employed are natural products such as rosin, dammer and linseed oil, phenol and alkyd resins modified with such natural products, and synthetic products such as silicone and acrylic resins. In the conventional negatively charged liquid developers, since the charge capacity of the toner particles is very low, the polarity is unstable and readily reversed. The results are that the dispersibility of the toner is poor, and images having high concentration cannot be obtained. Further, since the particle size of the toner is small, ground contamination is extreme with the result that images poor in sharpness are obtained. Moreover, in cases where natural products or resins modified with the natural products are employed, the properties and composition of the toner are varied, and it is difficult to obtain liquid developers of uniform quality.

SUMMARY OF THE INVENTION

It is a primary object of this invention to provide negatively charged liquid developers, that is, liquid developers with negatively charged toners, for use in electrostatic photography which substantially alleviate the foregoing defects of conventional liquid developers and which are characterized by excellent dispersion and polarity stability and the ability to provide sharp, highly concentrated images with minimum background stain.

In accordance with this invention, there is provided a negatively charged liquid developer for use in electrostatic photography which comprises a highly insulating carrier liquid and, dispersed therein, a toner comprising colored particles coated with a synthetic polymer composition comprising:

1. a mixture, A, of a copolymer (a) comprising the reaction product of a heteropolymer selected from the group consisting of styrene-butadiene heteropolymers and vinyltoluene-butadiene heteropolymers with an ester monomer selected from the group consisting of alkyl acrylates and methacrylates, wherein the alkyl group contains 6 to 18 carbon atoms; together with
2. a copolymer (b) having a molecular weight of from 5,000 to 30,000 comprising the reaction product of a monomer selected from the group consisting of acrylic and methacrylic acid with an ester monomer selected from the group consisting of alkyl acrylates and methacrylates wherein the alkyl group contains 6 to 18 carbon atoms:

the mixing weight ratio of copolymer (a) to copolymer (b) being from 1:2 to 15:1.

Mixture A may additionally contain for each part by weight thereof up to 20 parts by weight of a copolymer (c) comprising the reaction product of a heteropolymer selected from the group consisting of styrene-butadiene heteropolymers and vinyltoluene-butadiene heteropolymers with an alkyl methacrylate wherein the alkyl group contains from 6 to 18 carbon atoms and a monomer selected from the group consisting of acrylic and methacrylic acid.

Various polymers which may be used in the liquid developers of this invention will now be illustrated in detail.

Copolymer (a) for Use in Mixture A

This polymerization reaction product is prepared at a polymerization ratio higher than 90% by dissolving styrene-butadiene or vinyltoluene-butadiene heteropolymer in a solvent such as toluene, adding to the solution the selected alkyl acrylate or alkyl methacrylate in an amount of 0.5 to 3 parts by weight per part by weight of the heteropolymer, and reacting them at 80° to 90°C for about 5 hours in the presence of a polymerization initiator such as lauroyl peroxide or benzoyl peroxide. The resulting polymerization reaction product has an intrinsic viscosity of 0.5 to 0.7 and appears to be composed mainly of a three-dimensional copolymer comprising a stem of the styrene-butadiene or vinyltoluene-butadiene heteropolymer with the acrylate or alkyl methacrylate ester monomer grafted on the stem polymer.

The styrene-butadiene copolymer or vinyltoluene-butadiene heteropolymers used for this reaction will normally have a molecular weight of 50,000 to 300,000, although appreciable variation can be tolerated without adverse results. The preferred molecular weight is 50,000 to 200,000. It is preferred that the weight ratio of the styrene or vinyltoluene monomer to the butadiene monomer be from about 1:1 to 9:1.

The weight ratio of the reactants and the degree of polymerization is such that the weight ratio of ester monomer to heteropolymer is from about 0.5:1 to 3:1.

The preferred alkyl acrylates and alkyl methacrylates are hexyl acrylate, hexyl methacrylate, 2-ethylhexyl methacrylate, decyl acrylate, decyl methacrylate, lauryl methacrylate, lauryl acrylate and stearyl methacrylate.

Copolymer (b) for Use in Mixture A

This copolymer (b) is obtained by solution polymerization. More specifically, the copolymer (b) is obtained by mixing 0.05 to 0.3 mole of acrylic acid or methacrylic acid with 1 mole of the selected alkyl methacrylate or acrylate such as mentioned above, dissolving the mixture in a solvent such as toluene, the quantity of the solvent being almost equal to that of the monomer mixture, and reacting the monomers in the presence of a polymerization initiator such as azobisisobutyronitrile.

The weight ratio of reactants and the degree of polymerization is such that the weight ratio of acrylic or methacrylic acid to acid ester is from about 0.05:1 to 0.3:1.

The molecular weight of the so formed copolymer (b) is normally from 5,000 to 30,000, although some variation is possible. The same alkyl methacrylates and acrylates as exemplified with respect to copolymer (a) can be used for this reaction.

The mixing ratio of copolymer (a) to copolymer (b) in Mixture A is from 1:2 to 15:1.

Copolymer (c) Which May Be Added To Mixture A

Copolymer (c) is prepared according to a method similar to the method adopted for the preparation of copolymer (a). More specifically, copolymer (c) can be prepared at a polymerization ratio exceeding 90% by dissolving 1 part by weight of a styrene-butadiene or vinyltoluene-butadiene heteropolymer in a solvent such as toluene, adding 0.5 to 3 parts by weight of an alkyl methacrylate having 6 to 18 carbon atoms in the alkyl group and 0.002 to 0.01 part by weight of acrylic acid or methacrylic acid to the solution, and reacting them at 80° to 90°C for about 5 hours in the presence of a polymerization initiator. The resulting polymerization reaction product has an intrinsic viscosity of 0.5 to 0.7 and appears to be composed mainly of a tetramer comprising a stem polymer of the styrene-butadiene or vinyltoluene-butadiene heteropolymer with monomers of the alkyl methacrylate and the acrylic or methacrylic acid grafted thereon.

Preferred molecular weight and constituent monomer weight ratio of the styrene-butadiene or vinyltoluene-butadiene heteropolymer are within the same ranges as those mentioned with respect to copolymer (a).

The weight ratio of the reactants and the degree of polymerization is such that the weight ratio of heteropolymer to acid ester to acid is about 1:05 – 3:0.002 – 0.01.

Typically useful alkyl methacrylates for use in copolymer (c) include those employed in the preparation of copolymer (a).

The liquid developers of this invention are prepared in the conventional manner using conventional carrier liquids by mixing the selected polymer compositions with a dye or pigment in the presence of a small amount of a carrier liquid such as a petroleum hydrocarbon having a high resistance, typically exceeding $10^{10}\Omega$ and a low dielectric coefficient which normally does not exceed 3 to thereby form a concentrated toner which is dispersed uniformly in the selected carrier liquid which is usually the same as the liquid selected to prepare the concentrated toner.

Typical dyes or pigments which are effective for attaining the objects of this invention include pigments or dyes which do not impart a pH higher than 5 to an aqueous medium, such as carbon black, Aniline Black, Acetylene Black, Alkali Blue, Phthalocyanine Blue and Phthalocyanine Green. A wide variety of other colored pigments can be employed.

The negatively charged liquid developers of this invention have high charge capacities, good polarity stabilities with excellent dispersibility of toner particles in the carrier liquid. These excellent characteristics of the liquid developers of this invention appear to be due to the composition of Mixture A comprising copolymers (a), (b) and possibly (c). These excellent characteristics cannot be obtained utilizing any of the copolymers alone.

When a negatively charged liquid developer of this invention is applied to an electrostatically negative latent image formed on a photosensitive layer of a copying material for electrophotography, toner particles adhere to non-image areas to give a reverse copy image with high density, excellent sharpness and well adapted to be fixed by appropriate known means.

When a negatively charged liquid developer of this invention is applied to an electrostatically positive latent image formed on a photosensitive layer of a copying material for electrophotography, toner particles adhere to image areas to give a direct copy image having characteristics similar to the reverse copy image.

The invention is illustrated by the following non-limiting examples.

DESCRIPTION OF THE PREFERRED EMBODIMENTS

Example 1

100 parts by weight of a styrene-butadiene copolymer (styrene/butadiene mole ratio = 85/15; molecular weight = 100,000 – 150,000) was dissolved in 100 parts by weight of toluene. A mixture of 100 parts by weight of lauryl methacrylate, 100 parts by weight of toluene and 5 parts by weight of benzoyl peroxide was added dropwise to the solution, and the polymerization was conducted at 85°C for 5 hours. The resulting polymerization reaction product had a polymerization ratio of 95% and a solid content of 50%.

Next, 30 parts by weight of this polymerization reaction product was mixed with 5 parts by weight of Mogul A (carbon black manufactured by Cabot Incorp.), 4 parts by weight of lauryl methacrylate-acrylic acid copolymer (mole ratio = 9/1), 30 parts by weight of Isopar H (isoparaffin hydrocarbon manufactured by Exxon Company) and 31 parts by weight of Solvent Naphtha No. 6 (isoparaffin hydrocarbon of an aromatic component content of 25% manufacturing by Exxon Company), and the mixture was kneaded and dispersed for 24 hours in a ball mill to prepare a concentrated toner. Then, 1.2 g of this concentrated toner was dispersed in 1l of Isopar H to obtain a liquid developer of this invention.

A commercially available photosensitive paper for electrostatic photography having a negatively charged latent image was developed (negative-positive development) with use of the above liquid developer. As a result, there was obtained a sharp image characterized by an image density of 1.20 and a background density of 0.17 (available stain exclusive of the reflection density of 0.14 of the paper per se being 0.03). For comparison, the development of the same photosensitive paper was similarly conducted with the use of a liquid developer prepared by dispersing a commercially available concentrated toner for negative-positive development (it is understood that this concentrated toner contains carbon black and linseed oil or the like as a resin) in 1l of Isopar H. The resulting image was characterized by an image density of 0.80 and a background density of 0.20 (available stain being 0.06). When the zeta potentials of these liquid developers were measured according to the electrophoresis current method (reported by Kondo et al at 26th Conference of Society of Electrophotography of Japan), it was found that the comparative developer had a value of 85 mV and the developer of this invention had a value of 135 mV. When the particle sizes of these two developers were measured by means of a commercially available apparatus for measuring the particle size distribution, it was found that the liquid developer of this invention had an average toner particle size of 0.18 $\mu$, whereas the average toner particle size of the comparative liquid developer was 0.11 $\mu$. The improved properties of the product of this invention are apparent.

Example 2

Under the same conditions as described in Example 1, 100 parts by weight of a vinyltoluene-butadiene copolymer (molecular weight = 100,000 – 150,000; mole ratio = 85/15) was reacted with 150 parts by weight of 2-ethylhexyl methacrylate. 20 parts by weight of the resulting polymerization reaction product was mixed with 4 parts by weight of carbon black (MA 100 manufactured by Mitsubishi Kasei K.K.), 1 part by weight of Phthalocyanine Green (Chromophthal Green manufactured by Ciba Limited), 5 parts by weight of a 2-ethylhexyl methacrylate-acrylic acid copolymer (molecular weight = 100,000; mole ratio = 8/2) and 75 parts by weight of Isopar H (isoparaffin hydrocarbon manufactured by Exxon Company), and the mixture was kneaded in a ball mill for 48 hours to obtain a concentrated toner. Then, 5 g of this concentrated toner was dispersed in 1l of Isopar H to form a liquid developer for electrophotography.

When a positively electrostatically charged latent image of a surface potential of 800 V formed on a polyvinylcarbazole photosensitive layer was developed with the so formed liquid developer, there was obtained a sharp image having a resolution power of more than 150 lines per mm. The fixing property of the image is such that when the solvent remaining in the toner image was evaporated by a drier and the image surface hand rubbed violently, the image did not easily abrade from the paper surface.

The toner particles of the liquid developer obtained in this example have an excellent dispersibility in the carrier liquid and a good dispersion stability. This was established by the fact that the light transmission of the supernatant liquor obtained by centrifuging the so-prepared liquid developer at a rate of 4,000 rpm for 10 minutes using centrifugal separator was 51.0% while the light transmission of the liquid developer before the centrifugal separation was 50.5%.

Example 3

Under the same conditions as described in Example 1, 100 parts by weight of a vinyltoluene-butadiene copolymer (molecular weight = 100,000 – 150,000; mole ratio = 85/15) was reacted with 150 parts by weight of monomeric lauryl methacrylate. 20 parts by weight of the so formed polymerization reaction product and 20 parts by weight of another polymerization reaction product obtained by reacting 100 parts by weight of a vinyltoluene-butadiene copolymer (molecular weight = 100,000 – 150,000; mole ratio = 90/10) with 150 parts by weight of monomeric tridecyl methacrylate and 2 parts by weight of monomeric acrylic acid were mixed with 5 parts by weight of Mogul A (carbon black manufactured by Cabot Incorp.), 4 parts by weight of a 2-ethylhexyl methacrylate-methacrylic acid copolymer (molecular weight = 50,000; mole ratio = 9/1), 30 parts by weight of Isopar H (isoparaffin hydrocarbon manufactured by Exxon Company) and 31 parts by weight of Solvent Naphtha No. 6 (isoparaffin hydrocarbon of an aromatic component content of 25 % manufactured by Exxon Company). The mixture was kneaded in a ball mill for 24 hours to form a concentrated toner. Then, 1.5 g of the so prepared concentrated toner was dispersed in 1l of Isopar H to obtain a liquid developer. The properties of the so formed liquid developer were as excellent as that of the liquid developer obtained in Example 1.

Example 4

Under the same conditions as described in Example 1, 100 parts by weight of a styrene-butadiene copolymer (molecular weight = 100,000 – 150,000; mole ratio = 85/15) was reacted with 100 parts by weight of 2-ethylhexyl acrylate to obtain a polymerization reaction product (referred to as "polymerization reaction product (a)"). 20 parts of this polymerization reaction product was mixed with 4 parts by weight of carbon black (MA 100 manufactured by Mitsubishi Kasei K.K.), 1 part by weight of Cyanine Black (manufactured by Sumitomo Kagaku K.K.), 5 parts by weight of a lauryl methacrylate-methacrylic acid copolymer (molecular weight = 50,000; mole ratio = 9/1) and 75 parts by weight of Isopar H (isoparaffin hydrocarbon manufactured by Exxon Company), and the mixture was kneaded in a ball mill for 48 hours to obtain a concentrated toner.

For comparison, the following comparative products were prepared.

Comparative Example 1

25 parts by weight of the above polymerization reaction product (a) were mixed with 4 parts of carbon black (MA 100 manufactured by Mitsubishi Kasei K.K.), 1 part by weight of Cyanine Black (manufactured by Sumitomo Kagaku K.K.) and 75 parts of Isopar H (isoparaffin hydrocarbon manufactured by Exxon Company), and the mixture was kneaded in a ball mill for 48 hours to form a concentrated toner.

Comparative Example 2

25 parts by weight of a lauryl methacrylate-methacrylic acid copolymer (molecular weight = 50,000; mole ratio = 9/1) were mixed with 4 parts of carbon black (MA 100 manufactured by Mitsubishi Kasei K.K.), 1 part by weight of Cyanine Black (manufactured by Sumitomo Kagaku K.K.) and 75 parts by weight of Isopar H (isoparaffin hydrocarbon manufactured by Exxon Company), and the mixture was kneaded in a ball mill for 48 hours to obtain a concentrated toner.

With use of concentrated toners formed in Example 4 and Comparative Examples 1 and 2, three liquid developers for electrophotography were prepared by dispersing 1.2 g of the concentrated toner into 1l of Isopar H. Properties of the so formed three liquid developers were tested and compared with each other to obtain results shown in Table 1.

Table 1

| | Liquid Developers | | |
|---|---|---|---|
| | Exam. 4 | Comp. Exam. 1 | Comp. Exam. 2 |
| Fixing property[1] (kg/cm²) | 10 | 7 | 0.5 |
| Image density[2] | | | |
| just after preparation | 1.20 | 1.00 | 1.10 |
| 1 month after preparation | 1.15 | 0.90 | 1.00 |
| Density of non-image area[2] | | | |
| just after preparation | 0.17 | 0.18 | 0.16 |
| 1 month after preparation | 0.15 | 0.15 | 0.16 |
| Zeta Potential[3] (mV) | | | |
| just after preparation | 135 | 100 | 115 |
| 1 month after preparation | 125 | 85 | 100 |
| Dispersion stability | | | |

Table 1-continued

| | Liquid Developers | | |
|---|---|---|---|
| | Exam. 4 | Comp. Exam. 1 | Comp. Exam. 2 |
| (transmission)[4] | | | |
| just after preparation | 45% | 50% | 55% |
| 1 month after preparation | 46% | 55% | 65% |

Notes:

[1]Fixing property (kg/cm²)

In the eraser-rubbing test the value of this property was calculated from the number of strokes required for the reduction of the initial image density at 10% thereof by rubbing the surface with an eraser under the load of 100 g/cm².

[1]For instance, the fixing property value "10 kg/cm²" in Example 4 was calculated as below:

100 g/cm² × 100 (number of times)
= 10,000 g/cm² = 10 kg/cm²

[2]Image density

The image transmission density was determined using a photometer (PDA-11) (manufactured by Konishiroku Shashin K.K.).

[3]The zeta potential was calculated from current variation under conditions of 1 mm of inter-electrode distance and 15 V of applied voltage by the use of an electrophoresis current method (reported by Kondo et al. at 26th Conference of Society of Electrophotography).

[4]Dispersion stability (transmission)

The dispersion stability was investigated from variation in transmission measured on a 1 mm thick silica glass cell by using a turbidimeter with an integrating sphere (manufactured by Nihon Seimitsu Kogaku K.K).

From the foregoing results, it will readily be understood that the liquid developer of this invention gives copy images having good fixing properties and high image densities, and that the dispersion stability of the toner is excellent in the liquid developer of this invention.

What is claimed is:

1. A negatively charged liquid developer for use in electrostatic photography which comprises a highly insulating carrier liquid and, dispersed therein, a toner comprising colored particles coated with a synthetic polymer composition comprising:

1. a mixture, A, of a copolymer (a) comprising the reaction product of a heteropolymer selected from the group consisting of styrene-butadiene heteropolymers and vinyltoluene-butadiene heteropolymers with an ester monomer selected from the group consisting of alkyl acrylates and methacrylates, wherein the alkyl group contains 6 to 18 carbon atoms; together with
2. a copolymer (b) having a molecular weight of from 5,000 to 30,000 comprising the reaction product of a monomer selected from the group consisting of acrylic and methacrylic acid with an ester monomer selected from the group consisting of alkyl acrylates and methacrylates wherein the alkyl group contains 6 to 18 carbon atoms: the mixing weight ratio of copolymer (a) to copolymer (b) being from 1:2 to 15:1, the molecular weight of a heteropolymer being from 50,000 to 300,000 and the weight ratio of styrene or vinyltoluene to butadiene being from 1:1 to 9:1 the weight ratio of ester monomer to heteropolymer being from about 0.5:1 to 3:1, the weight ratio of acrylic or methacrylic acid to acid ester being from about 0.05:1 to 0.3:1.

2. A liquid developer as in claim 1 wherein Mixture A, for each part by weight thereof, additionally contains up to 20 parts by weight of a copolymer (c) comprising the reaction product of a heteropolymer selected from the group consisting of styrene-butadiene heteropolymers and vinyltoluene-butadiene heteropolymers with an alkyl methacrylate wherein the alkyl group contains from 6 to 18 carbon atoms and a monomer selected from the group consisting of acrylic and methacrylic acid, the molecular weight of a heteropolymer being from 50,000 to 300,000 and the weight ratio of styrene or vinyl-toluene to butadiene being from 1:1 to 9:1, the weight ratio of heteropolymer to acid ester to acid being about 1:0.5 – 3:0.002 – 0.01.

3. A liquid developer as in claim 1 wherein the ester monomer of copolymer (a) is selected from the group consisting of hexyl, decyl, lauryl and stearyl acrylate; and hexyl, 2-ethylhexyl, decyl, lauryl and stearyl methacrylate.

4. A liquid developer as in claim 1 wherein the ester monomer of copolymer (b) is selected from the group consisting of hexyl, decyl, lauryl and stearyl acrylate; and hexyl, 2-ethylhexyl, decyl, lauryl and stearyl methacrylate.

5. A liquid developer as in claim 2 wherein the ester monomer of copolymer (a) is selected from the group consisting of hexyl, decyl, lauryl and stearyl acrylate; and hexyl, 2-ethylhexyl, decyl, lauryl and stearyl methacrylate.

6. A liquid developer as in claim 2 wherein the ester monomer of copolymer (b) is selected from the group consisting of hexyl, decyl, lauryl and stearyl acrylate; and hexyl, 2-ethylhexyl, decyl, lauryl and stearyl methacrylate.

7. A liquid developer as in claim 1 wherein copolymer (a) is the reaction product of lauryl methacrylate with a styrene-butadiene heteropolymer and copolymer (b) is the reaction product of lauryl methacrylate and acrylic acid.

8. A liquid developer as in claim 1 wherein copolymer (a) is the reaction product of 2-ethylhexyl methacrylate with a vinyltoluene-butadiene heteropolymer, and copolymer (b) is the reaction product of 2-ethylhexyl methacrylate and acrylic acid.

9. A liquid developer as in claim 1 wherein copolymer (a) is the reaction product of 2-ethylhexyl methacrylate and a styrene-butadiene heteropolymer and copolymer (b) is the reaction product of lauryl methacrylate and methacrylic acid.

10. A liquid developer as in claim 2 wherein copolymer (a) is the reaction product of lauryl methacrylate and a vinyltoluene-butadiene heteropolymer, copolymer (b) is the reaction product of 2-ethylhexyl methacrylate and methacrylic acid, and copolymer (c) is the reaction product of acrylic acid, tridecyl methacrylate and a vinyltoluene-butadiene heteropolymer.

11. A negatively charged toner for use in electrostatic photography comprising colored particles coated with a synthetic polymer composition comprising:

1. a mixture, A, of a copolymer (a) comprising the reaction product of a heteropolymer selected from the group consisting of styrene-butadiene heteropolymers and vinyltoluene-butadiene heteropolymers with an ester monomer selected from the group consisting of alkyl acrylates and methacrylates, wherein the alkyl group contains 6 to 18 carbon atoms; together with
2. a copolymer (b) having a molecular weight of from 5,000 to 30,000 comprising the reaction product of a monomer selected from the group consisting of acrylic and methacrylic acid with an ester monomer selected from the group consisting of alkyl acrylates and methacrylates wherein the alkyl group contains 6 to 18 carbon atoms: the mixing weight ratio of copolymer (a) to copolymer (b) being from 1:2 to 15:1, the molecular weight of a heteropolymer being from 50,000 to 300,000 and the weight ratio of styrene or vinyltoluene to butadiene being from 1:1 to 9:1, the weight ratio of ester monomer to heteropolymer being from about 0.5:1 to 3:1, the weight ratio of acrylic or methacrylic acid to acid ester being from about 0.05:1 to 0.3:1.

12. A toner as in claim 11 wherein Mixture A, for each part by weight thereof, additionally contains up to 20 parts by weight of a copolymer (c) comprising the reaction product of a heteropolymer selected from the group consisting of styrene-butadiene heteropolymers and vinyltoluene-butadiene heteropolymers with an alkyl methacrylate wherein the alkyl group contains from 6 to 18 carbon atoms and a monomer selected from the group consisting of acrylic and methacrylic acid, the molecular weight of a heteropolymer being from 50,000 to 300,000 and the weight ratio of styrene or vinyltoluene to butadiene being from 1:1 to 9:1, the weight ratio of heteropolymer to acid ester to acid being about 1:0.5 – 3:0.002 – 0.01.

13. A toner as in claim 11 wherein the ester monomer of copolymer (a) is selected from the group consisting of hexyl, decyl, lauryl and stearyl acrylate; and hexyl, 2-ethylhexyl, decyl, lauryl and stearyl methacrylate.

14. A toner as in claim 11 wherein the ester monomer of copolymer (b) is selected from the group consisting of hexyl, decyl, lauryl and stearyl acrylate; and hexyl, 2-ethylhexyl, decyl, lauryl and stearyl methacrylate.

15. A toner as in claim 12 wherein the ester monomer of copolymer (a) is selected from the group consisting of hexyl, decyl, lauryl and stearyl acrylate; and hexyl, 2-ethylhexyl, decyl, lauryl and stearyl methacrylate.

16. A toner as in claim 12 wherein the ester monomer of copolymer (b) is selected from the group consisting of hexyl, decyl, lauryl and stearyl acrylate; and hexyl, 2-ethylhexyl, decyl, lauryl and stearyl methacrylate.

17. A toner as in claim 11 wherein copolymer (a) is the reaction product of lauryl methacrylate with a styrene-butadiene heteropolymer and copolymer (b) is the reaction product of lauryl methacrylate and acrylic acid.

18. A toner as in claim 11 wherein copolymer (a) is the reaction product of 2-ethylhexyl methacrylate with a vinyltoluene-butadiene heteropolymer, and copolymer (b) is the reaction product of 2-ethylhexyl methacrylate and acrylic acid.

19. A toner as in claim 11 wherein copolymer (a) is the reaction product of 2-ethylhexyl methacrylate and a styrene-butadiene heteropolymer and copolymer (b) is the reaction product of lauryl methacrylate and methacrylic acid.

20. A toner as in claim 12 wherein copolymer (a) is the reaction product of lauryl methacrylate and a vinyltoluene-butadiene heteropolymer, copolymer (b) is the reaction product of 2-ethylhexyl methacrylate and methacrylic acid, and copolymer (c) is the reaction product of acrylic acid, tridecyl methacrylate and vinyltoluene-butadiene heteropolymer.

* * * * *